US008291724B2

(12) United States Patent
Shikazono et al.

(10) Patent No.: US 8,291,724 B2
(45) Date of Patent: Oct. 23, 2012

(54) FIN STRUCTURE FOR FIN TUBE HEAT EXCHANGER

(75) Inventors: Naoki Shikazono, Tokyo (JP); Nobuhide Kasagi, Tokyo (JP); Yuji Suzuki, Tokyo (JP); Yoshinori Suzue, Tokyo (JP); Kenichi Morimoto, Tokyo (JP)

(73) Assignee: The University of Tokyo, Tokyo (JP)

( * ) Notice: Subject to any disclaimer, the term of this patent is extended or adjusted under 35 U.S.C. 154(b) by 611 days.

(21) Appl. No.: 11/989,229

(22) PCT Filed: Jul. 28, 2006

(86) PCT No.: PCT/JP2006/315049

§ 371 (c)(1),
(2), (4) Date: Jan. 29, 2008

(87) PCT Pub. No.: WO2007/013623

PCT Pub. Date: Feb. 1, 2007

(65) Prior Publication Data

US 2008/0264098 A1 Oct. 30, 2008

(30) Foreign Application Priority Data

Jul. 29, 2005 (JP) ..... 2005-220783

(51) Int. Cl.
*F25B 39/02* (2006.01)

(52) U.S. Cl. ..... 62/515

(58) Field of Classification Search ..... 62/515, 62/523; 165/151, 182
See application file for complete search history.

(56) References Cited

U.S. PATENT DOCUMENTS 3,515,207 A * 6/1970 Lu ..... 165/151
6,349,761 B1 * 2/2002 Liu et al. ..... 165/151

FOREIGN PATENT DOCUMENTS

| | | |
|---|---|---|
| JP | A 1-219497 | 9/1989 |
| JP | A 2000-193389 | 7/2000 |
| JP | A 2003-161588 | 6/2003 |
| JP | A 2003-314973 | 11/2003 |

* cited by examiner

*Primary Examiner* — Melvin Jones
(74) *Attorney, Agent, or Firm* — Oliff & Berridge, PLC

(57) ABSTRACT

A heat exchanger has multiple laminated fins 30. Each fin 30 has multiple tops 34 and multiple bottoms 36 arranged to have a preset acute angle γ (for example, 30 degrees) to an air flow line at an air inlet and to make an air flow in a cavity region behind each of multiple heat transfer tubes 22*a* to 22*c* in an air flow direction at an air outlet. This design of the fins 30 produces effective secondary flows of the air to improve the heat transfer efficiency and makes an additional contribution to heat exchange, due to the air flow in the cavity region behind each of the heat transfer tubes 22*a* to 22*c* in the air flow direction. This arrangement effectively prevents separation of the air flow and a local speed increase of the air flow, while improving the overall heat exchange efficiency by production of the effective secondary flows of the air.

11 Claims, 6 Drawing Sheets

FIN STRUCTURE FOR FIN TUBE HEAT EXCHANGER

TECHNICAL FIELD

The present invention relates to a heat exchanger, as well as an air conditioning device equipped with the heat exchanger and an air property converter. More specifically the invention pertains to a heat exchanger for heat exchange between the air and a heat exchange medium, as well as an air conditioning device equipped with such a heat exchanger and an air property converter that changes the property of the inflow air and flows out the air of the changed property.

BACKGROUND ART

Various f in structures have been proposed for a fin tube heat exchanger having multiple parallel fins and multiple heat transfer tubes arranged to pass through the multiple fins. One proposed structure is slit fins with long slits (see, for example, Patent Document 1). Another proposed structure is corrugated fins having concaves and convexes arranged perpendicular to an air flow direction (see, for example, Patent Document 2). These proposed fin structures aim to promote the heat transfer performance in the fin tube heat exchanger.

Patent Document 1: Japanese Patent Laid-Open No. 2003-161588

Patent Document 2: Japanese Patent Laid-Open No. 2000-193389

DISCLOSURE OF THE INVENTION

In the conventional fin tube heat exchanger, these proposed fin structures improve the heat transfer coefficient but may undesirably increase the ventilation resistance by separation of the air flow or a local speed increase of the air flow due to the projections or the cutting. In application of the conventional heat exchanger to an evaporator in a refrigeration cycle, the water vapor included in the air forms dew condensation water or frost and adheres to the heat exchanger. The condensed water or the frost may clog the slits and interfere with the smooth air flow.

In a heat exchanger and an air conditioning device equipped with the heat exchanger, there would thus be a demand for preventing separation of the air flow and a local speed increase of the air flow. In the heat exchanger and the air conditioning device equipped with the heat exchanger, there would also be a demand for producing effective secondary flows of the air to improve the heat exchange efficiency. Another demand would be size reduction of the heat exchanger and the air conditioning device equipped with the heat exchanger. In an air property converter, there would be a demand for preventing separation of the air flow and a local speed increase of the air flow, while attaining efficient change of the property of the air and enabling size reduction.

The present invention accomplishes at least part of the demands mentioned above by the following configurations applied to the heat exchanger, the air conditioning device equipped with the heat exchanger, and the air property converter.

One aspect of the invention pertains to a heat exchanger for heat exchange between the air and a heat exchange medium, the heat exchanger includes: multiple heat transfer tubes arranged in parallel to each other as flow paths of the heat exchange medium; and multiple corrugated fin members configured to have wave forms and provide an air inlet for inflow of the air, an air outlet for outflow of the air, and an air flow path connecting the air inlet with the air outlet and making heat exchange with the multiple heat transfer tubes, the multiple fin members being arranged to have a preset acute angle formed by each wave form and an air flow line in at least a predetermined range in a direction from the air inlet to the air outlet.

In the heat exchanger according to this aspect of the invention, the multiple fin members are arranged to have the preset acute angle formed by each wave form and the air flow line in the predetermined range in the direction from the air inlet to the air outlet. This arrangement ensures production of secondary flow components effective for promotion of heat transfer without causing separation of the air flow. The presence of such secondary flows effectively prevents a local speed increase of the air flow and improves the overall heat exchange efficiency, thus enabling size reduction of the heat exchanger. Each of the multiple heat transfer tubes may have either a substantially circular cross section or a substantially rectangular cross section. The multiple fin members may be corrugated members laminated in parallel to one another.

In one preferable embodiment of the heat exchanger according to the above aspect of the invention, the multiple fin members are arranged to make each wave form symmetrical about a center of each adjacent set of the multiple heat transfer tubes. The air flow is thus symmetrical about the center of the adjacent set of the multiple heat transfer tubes.

In another preferable embodiment of the heat exchanger according to the above aspect of the invention, the multiple fin members are arranged to have the wave forms such that the air flows in a cavity region behind each of the multiple heat transfer tubes in an air flow direction. This makes the air flow in the cavity region behind each of the multiple heat transfer tubes in the air flow direction, thus further improving the overall heat exchange efficiency.

In still another preferable embodiment of the heat exchanger according to the above aspect of the invention, the multiple fin members are arranged to have the wave forms such that a top-connecting line of connecting tops of each wave form is bent multiple times. In the heat exchanger of this embodiment, the multiple fin members may be arranged to have the wave forms such that a curve of interconnecting bent points of the top-connecting lines of adjacent wave forms is consistent with the air flow line in the predetermined range.

In another preferable embodiment of the heat exchanger according to the above aspect of the invention, the multiple fin members are designed to give a Reynolds number of not less than 10, which is defined by an air flow rate 'u' and an amplitude 'h' of the wave form. At the Reynolds number of not less than 10, the inertial force of the air flow exceeds the viscous force of the air flow, and the dynamic pressure is converted into the static pressure at convex front stagnation points in the wave forms. The pressure difference between the dynamic pressure and the static pressure causes secondary flows effective for promotion of the heat transfer.

In still another preferable embodiment of the heat exchanger according to the above aspect of the invention, the preset acute angle is in a range of 10 degrees to 60 degrees. This angle range effectively prevents separation of the air flow and a local speed increase of the air flow. The preset acute angle is preferably in a range of 15 degrees to 45 degrees and more preferably in a range of 25 degrees to 35 degrees. The most preferable angle is 30 degrees.

In one preferable structure of the heat exchanger according to the above aspect of the invention, the multiple fin members provide the air flow path connecting the air inlet with the air outlet and intersecting with the multiple heat transfer tubes in a heat exchangeable manner. In another preferable structure of the heat exchanger according to the above aspect of the invention, the multiple heat transfer tubes provide, in combination with the multiple fin members, at least one of the air inlet and the air outlet.

Another aspect of the invention pertains to an air conditioning device configured as a refrigeration cycle with application of a heat exchanger to at least one of an evaporator and a condenser. The heat exchanger for heat exchange between the air and a heat exchange medium basically has: multiple heat transfer tubes arranged in parallel to each other as flow paths of the heat exchange medium; and multiple corrugated fin members configured to have wave forms and provide an air inlet for inflow of the air, an air outlet for outflow of the air, and an air flow path connecting the air inlet with the air outlet and making heat exchange with the multiple heat transfer tubes. The multiple fin members are arranged to have a preset acute angle formed by each wave form and an air flow line in at least a predetermined range in a direction from the air inlet to the air outlet.

The air conditioning device according to this aspect of the invention is equipped with the heat exchanger of the invention having any of the above arrangements and accordingly has the similar advantages to those of the heat exchanger described above, that is, producing the secondary flow components effective for promotion of heat transfer without causing separation of the air flow, preventing a local speed increase of the air flow, and improving the heat exchange efficiency. These effects enable size reduction of the air conditioning device.

According to another aspect, the present invention is directed to an air property converter that changes a property of an inflow air and flows out the air of the changed property, the air property converter includes: multiple corrugated fin members configured to have wave forms and provide an air inlet for inflow of the air, an air outlet for outflow of the air, and an air flow path connecting the air inlet with the air outlet, the multiple fin members being arranged to have a preset acute angle formed by each wave form and an air flow line in at least a predetermined range in a direction from the air inlet to the air outlet.

In air property converter according to this aspect of the invention, the multiple fin members are arranged to have the preset acute angle formed by each wave form and the air flow line in the predetermined range in the direction from the air inlet to the air outlet. This arrangement ensures production of secondary flow components effective for promotion of conversion of the air property without causing separation of the air flow. The presence of such secondary flows effectively prevents a local speed increase of the air flow and improves the overall conversion efficiency of the air property, thus enabling size reduction of the air property converter. One typical example of the conversion of the air property is a change from the mist-rich air to the mist-lean air. In this case, the air property converter is a mist separator. The multiple fin members may be corrugated members laminated in parallel to one another.

BEST MODES OF CARRYING OUT THE INVENTION

One mode of carrying out the invention is discussed below as a preferred embodiment.

Figure 1:
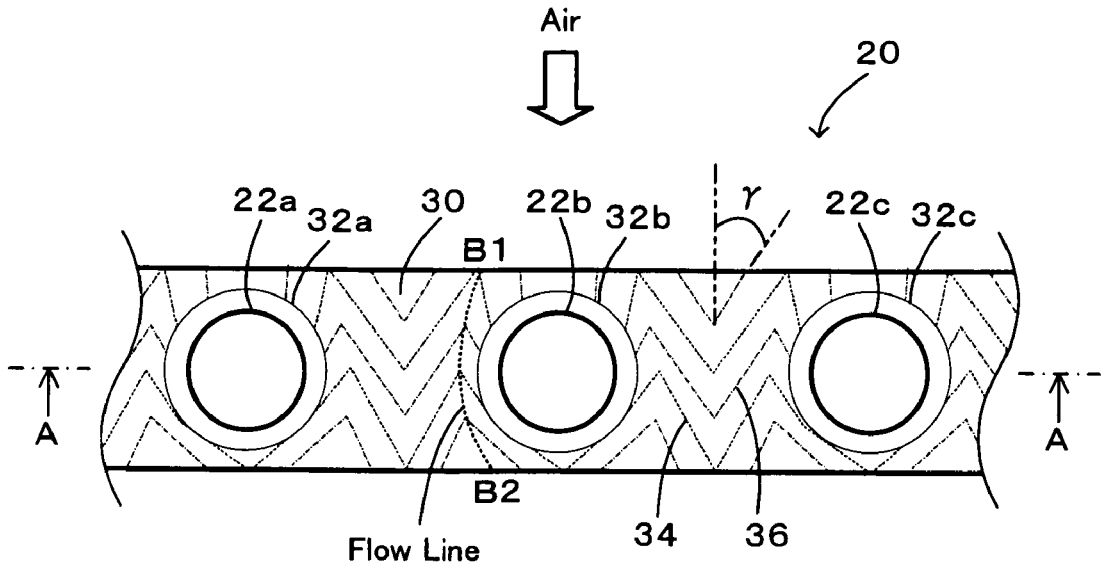
FIG. 1 schematically illustrates the structure of a fin tube heat exchanger 20 according to one embodiment of the invention.
Figure 2:
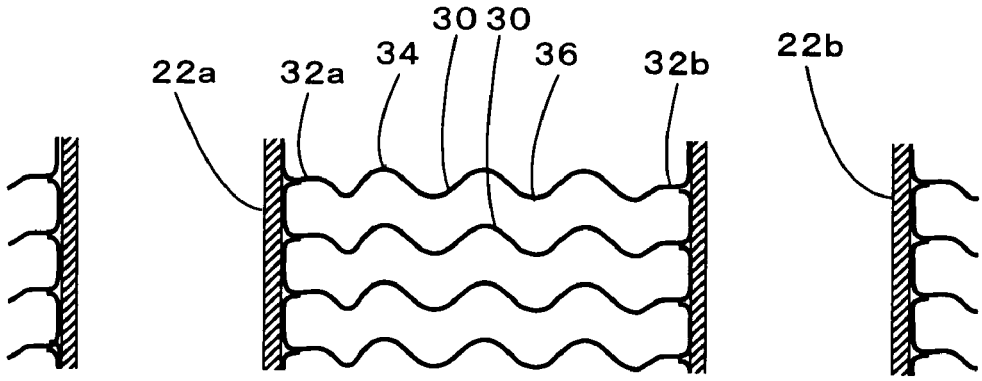
FIG. 2 is an enlarged sectional view of the fin tube heat exchanger 20 taken on a line A-A in FIG. 1.

FIG. 1 schematically illustrates the structure of a fin tube heat exchanger 20 according to one embodiment of the invention. FIG. 2 is an enlarged sectional view of the fin tube heat exchanger 20 taken on a line A-A in FIG. 1. The illustrated area of FIG. 2 covers a peripheral range between a heat transfer tube 22*a* and a heat transfer tube 22*b*. As illustrated, the fin tube heat exchanger 20 of the embodiment has multiple heat transfer tubes 22*a* to 22*c* arranged in parallel to one another as flow paths of a heat exchange medium, and multiple fins 30 provided substantially perpendicular to these multiple heat transfer tubes 22*a* to 22*c*.

The multiple heat transfer tubes 22*a* to 22*c* are arranged in parallel to one another to make crooked flows or split flows of a heat exchange medium, for example, a cooling liquid such as cooling water or cooling oil or a refrigerant gas used in refrigeration cycles, while being disposed substantially perpendicular to the air flow for cooling.

As shown in FIGS. 1 and 2, the multiple fins 30 are constructed as multiple corrugated plates having multiple curved tops 34 shown by the broken line in FIG. 1 and multiple curved bottoms 36 located between the respective tops 34 and shown by the one-dot chain line in FIG. 1. The multiple fins 30 are arranged at fixed intervals in substantially parallel to one another and attached to the respective heat transfer tubes 22*a* to 22*c* to be substantially perpendicular to the flow direction of the heat exchange medium through the heat transfer tubes 22*a* to 22*c*. The multiple fins 30 have mounts 32*a* to 32*c* formed as flat portions without the tops 34 and the bottoms 36 for the improved attachability to the heat transfer tubes 22*a* to 22*c*. In the structure of the embodiment shown in FIG. 1, the multiple fins 30 provide an air inlet on an upper side (in the drawing) of the fin tube heat exchanger 20 and an air outlet on a lower side (in the drawing) and define air flow paths between the respective heat transfer tubes 22*a* to 22*c*.

Figure 3:
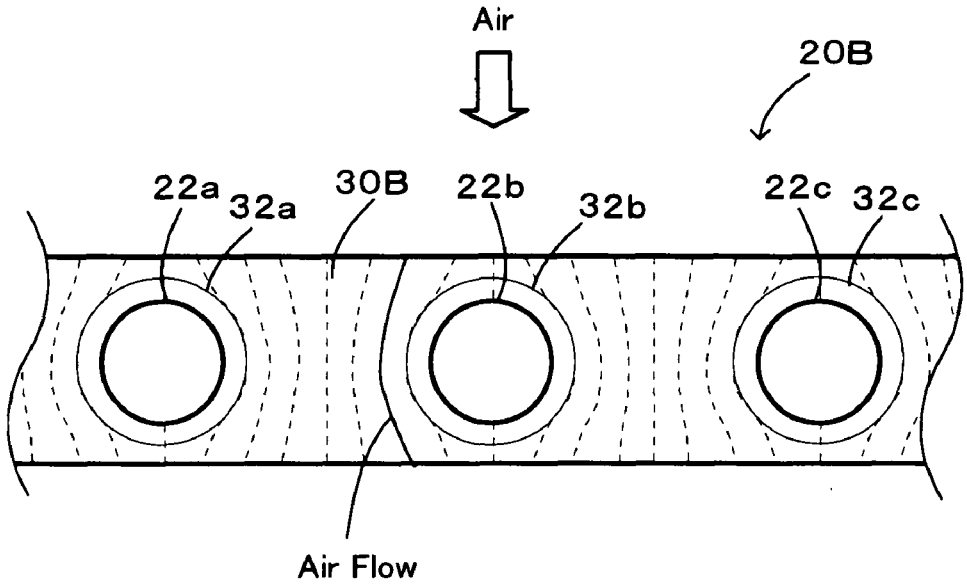
FIG. 3 shows an air flow line in a fin tube exchanger 20B with fins 30B of simple flat plates.
Figure 4:
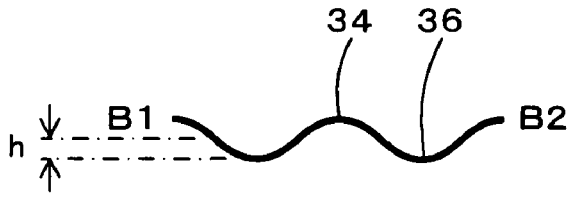
FIG. 4 is a sectional view of a fin 30 taken on a curve Bl-B2 of FIG. 1 interconnecting the bents of tops 34 and bottoms 36 of the fin 30.
Figure 5:
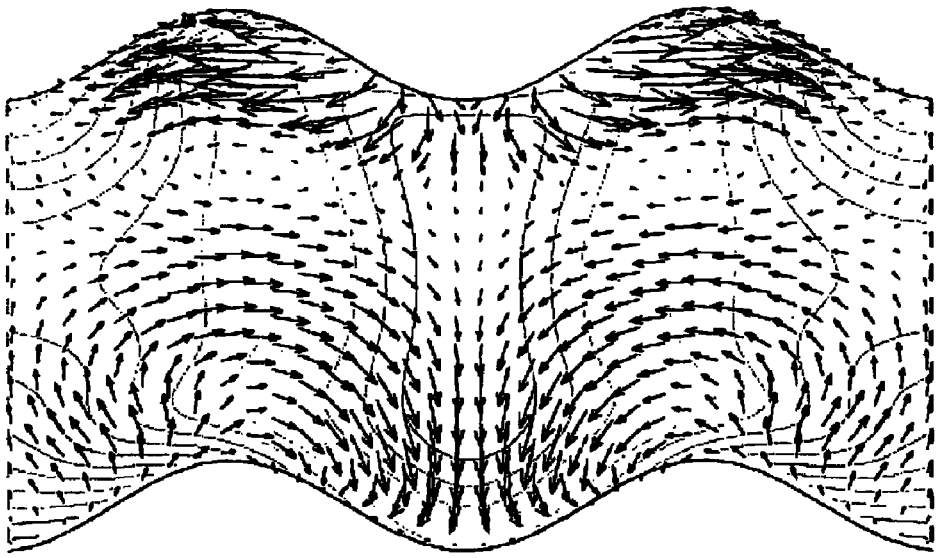
FIG.5 shows isothermal curves with secondary flows of the air produced on a corrugated plate when a uniform air flow of a low flow rate is introduced to the corrugated plate.

The multiple tops 34 and the multiple bottoms 36 of each fin 30 are arranged to have a preset acute angle γ, for example, 30 degrees, formed by their continuous lines (the broken line and the one-dot chain line) and an air flow direction (a flow line) at the air inlet. The multiple tops 34 and the multiple bottoms 36 of each fin 30 are also arranged to be symmetrical about the air flow line on the center of each adjoining set of the heat transfer tubes 22*a* to 22*c*. A curve interconnecting the bents of the tops 34 and the bottoms 36 is accordingly consistent with the air flow line at the air inlet. FIG. 3 shows an air flow line in a fin tube exchanger 20B with fins 30B of simple flat plates having no tops 34 or bottoms 36. FIG. 4 is a sectional view of the fin 30 taken on a curve B1-B2 of FIG. 1 interconnecting the bents of the tops 34 and the bottoms 36 of the fin 30. As illustrated, the cross section of the fin 30 taken on the curve B1-B2 has a corrugated shape having the alternately arranged tops 34 and bottoms 36. The design of the fin 30 to have the preset acute angle γ formed by the continuous lines (the broken line and the one-dot chain line) of the tops 34 and the bottoms 36 and the air flow direction (the flow line) at the air inlet aims to produce effective secondary flows of the air. FIG. 5 shows isothermal curves with secondary flows of the air (shown by the arrows) produced on a corrugated plate when a uniform air flow of a low flow rate is introduced to the corrugated plate. As shown in FIG. 5, the presence of the tops 34 and the bottoms 36 causes strong secondary flows, and there is a significant temperature gradient in the vicinity of the wall surface. In the structure of the embodiment, the effective secondary flows of the air are produced by setting 30 degrees to the angle γ formed by the continuous lines (the broken line and the one-dot chain line) of the tops 34 and the bottoms 36 and the air flow line. The excessively small angle γ fails to produce the effective secondary flows of the air, while the excessively large angle γ interferes with the air flow along the tops 34 and the bottoms 36 and causes separation of the air flow and a local speed increase of the air flow to increase the ventilation resistance. The angle γ should be an acute angle to ensure production of the secondary flows of the air and is preferably in a range of 10 to 60 degrees, more specifically in a range of 15 to 45 degrees, and ideally in a range of 25 to 35 degrees. Based on this consideration, the structure of the embodiment sets 30 degrees to the angle γ. In the case of the air flow having a low flow rate, the presence of the tops 34 and the bottoms 36 produces the effective secondary flows of the air, while the main stream of the air flow keeps a flow line substantially identical with the flow line on the simple flat plate without the tops 34 and the bottoms 36.

The multiple tops 34 and the multiple bottoms 36 of each fin 30 are arranged to make the air flow in a cavity region behind each of the heat transfer tubes 22*a* to 22*c* in the air flow direction at the air outlet. This arrangement of making the air flow in the cavity region behind each of the heat transfer tubes 22*a* to 22*c* in the air flow direction makes a further contribution to the heat exchange.

Figure 6:
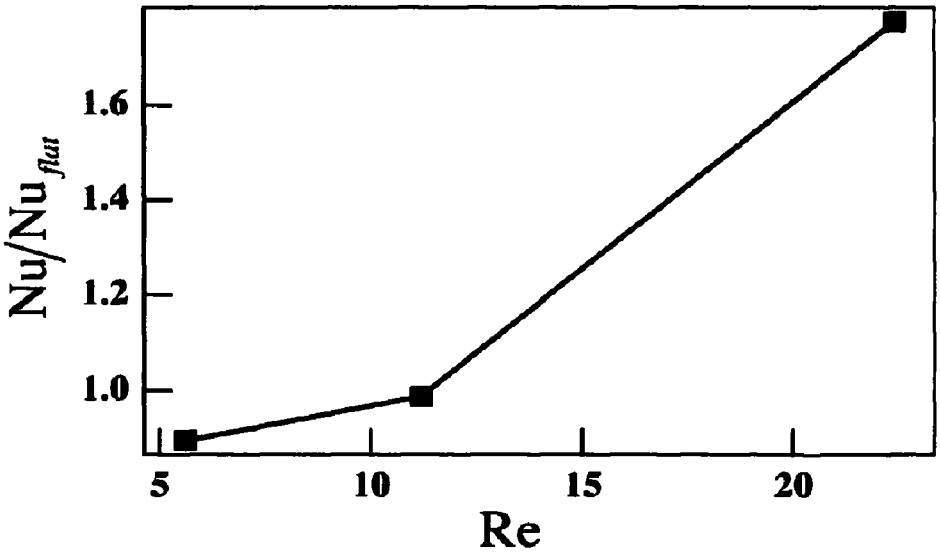
FIG. 6 is a graph showing a progress rate of the fin 30 of the embodiment relative to a flat fin with regard to a Nusselt number as a dimensionless heat transfer coefficient representing the heat transfer performance.
Figure 7:
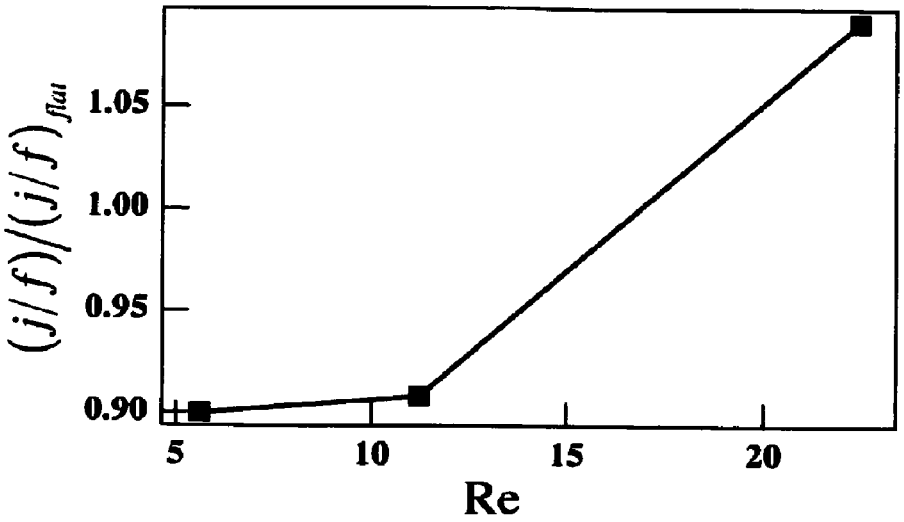
FIG. 7 is a graph showing a progress rate of the fin 30 of the embodiment relative to the flat fin with regard to a j/f factor as a ratio of the heat transfer performance to the ventilation resistance.

In the structure of the embodiment, a wave amplitude 'h' of the tops 34 and the bottoms 36 of each fin 30 (see FIG. 4) and the interval of the respective fins 30 are determined to give the Reynolds number of not lower than 10, which is defined by an average air flow rate 'u' between the adjacent fins 30 and the amplitude 'h' of the wave formed by the tops 34 and the bottoms 36 of the fin 30. FIG. 6 is a graph showing a progress rate of the fin 30 of the embodiment relative to a flat fin with regard to a Nusselt number as a dimensionless heat transfer coefficient representing the heat transfer performance. The Nusselt number on the ordinate of FIG. 6 is standardized by a Nusselt number $(Nu)_{flat}$ of the flat fin. As clearly understood from the graph of FIG. 6, the presence of the tops 34 and the bottoms 36 formed on the fin 30 has a significant effect to abruptly increase the Nusselt number at the Reynolds number of not lower than 10. FIG. 7 is a graph showing a progress rate of the fin 30 of the embodiment relative to the flat fin with regard to a j/f factor as a ratio of the heat transfer performance to the ventilation resistance. The j/f factor on the ordinate of FIG. 7 is standardized by a j/f factor $(j/f)_{flat}$ of the flat fin, where 'j' denotes a Colburn j factor and 'f' represents a friction coefficient. As clearly understood from the graph of FIG. 7, the presence of the tops 34 and the bottoms 36 formed on the fin 30 has a significant effect to abruptly increase the j/f factor at the Reynolds number of not lower than 10.

In the fin tube heat exchanger 20 of the embodiment described above, the tops 34 and the bottoms 36 of each fin 30 are arranged to have the preset acute angle γ (for example, 30 degrees) to the air flow line at the air inlet. This arrangement enables production of effective secondary flows of the air to improve the heat transfer efficiency and accordingly increases the overall heat exchange efficiency. The increased overall heat exchange efficiency desirably enables size reduction of the fin tube heat exchanger 20 of the embodiment. In the fin tube heat exchanger 20 of the embodiment, the respective fins 30 are attached to the heat transfer tubes 22*a* to 22*c*, and the tops 34 and the bottoms 36 of each fin 30 are designed to have the Reynolds number of not lower than 10, which is defined by the average air flow rate 'u' between the adjacent fins 30 and the amplitude 'h' of the wave formed by the tops 34 and the bottoms 36 of the fin 30. This arrangement effectively improves the heat transfer performance.

In the fin tube heat exchanger 20 of the embodiment, the tops 34 and the bottoms 36 of each fin 30 are arranged to make the air flow in the cavity region behind each of the heat transfer tubes 22*a* to 22*c* in the air flow direction at the air outlet. This arrangement of making the air flow in the cavity region behind each of the heat transfer tubes 22*a* to 22*c* in the air flow direction makes an additional contribution to the heat exchange. Such contribution further improves the overall heat exchange efficiency of the fin tube heat exchanger 20.

In the fin tube heat exchanger 20 of the embodiment, each fin 30 has the corrugated structure of the tops 34 and the bottoms 36. This arrangement neither requires cutting of the fin nor narrows the interval between adjacent fins, thus effectively preventing separation of the air flow and a local speed increase of the air flow. In application of the fin tube heat exchanger 20 to an evaporator, this arrangement effectively prevents the condensed water or frost from clogging and interfering with the smooth air flow.

Figure 8:
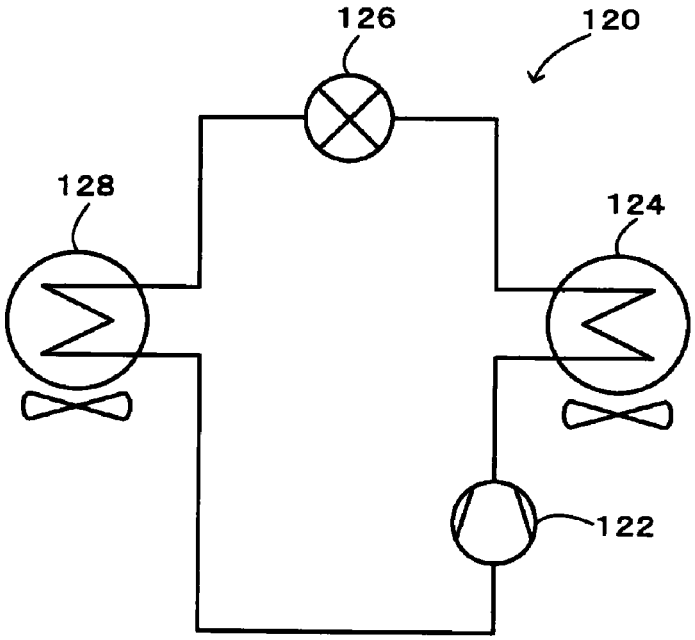
FIG. 8 schematically illustrates the structure of a refrigeration cycle 120 with application of the fin tube heat exchanger 20 of the embodiment to a condenser 124 and an evaporator 128.

FIG. 8 schematically illustrates the structure of a refrigeration cycle 120 with application of the fin tube heat exchanger 20 of the embodiment to a condenser 124 and an evaporator 128. The illustrated refrigeration cycle 120 includes a compressor 122 to compress a low-temperature, low-pressure gas-phase refrigerant to a high-temperature, high-pressure gas-phase refrigerant, the condenser 124 to cool down the high-temperature, high-pressure gas-phase refrigerant by heat exchange with the outside air to a low-temperature, high-pressure liquid-phase refrigerant, a decompressor 126 to reduce the pressure of the low-temperature, high-pressure liquid-phase refrigerant to a two-phase refrigerant, and the evaporator 128 to convert the two-phase refrigerant to the low-temperature, low-pressure gas-phase refrigerant by heat exchange with the outside air. The refrigeration cycle 120 may function as a heat pump to heat the room in application of the condenser 124 as an indoor unit and the evaporator 128 as an outdoor unit. Since the functions of the refrigeration cycle 120 are equivalent to the functions of a conventional refrigeration cycle and are not characteristic of the present invention, no detailed explanation is given here. In the refrigeration cycle 120, the fin tube heat exchanger 20 of the embodiment is applied to both the condenser 124 and the evaporator 128. The increased heat transfer efficiency of the condenser 124 and the evaporator 128 effectively improves the overall energy efficiency of the refrigeration cycle 120 and thus attains size reduction of the refrigeration cycle 120. In one possible modification, the fin tube heat exchanger 20 of the embodiment may be applied to only one of the condenser 124 and the evaporator 128.

Figure 9:
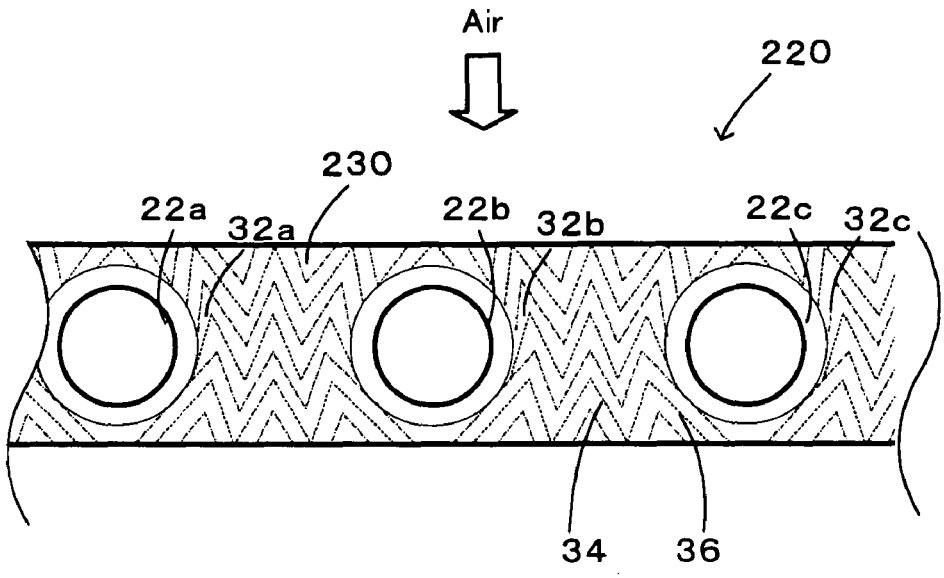
FIG. 9 schematically illustrates the structure of another fin tube heat exchanger 220 in one modified example.

In the fin tube heat exchanger 20 of the embodiment, the tops 34 and the bottoms 36 formed on each fin 30 are bent three times between each adjacent set of the heat transfer tubes 22*a* to 22*c* as shown in FIG. 1. The number of bents of the tops 34 and bottoms 36 is, however, not restricted to three times but may be set arbitrarily. In a fin tube heat exchanger 220 of a modified example shown in FIG. 9, the tops 34 and the bottoms 36 formed on each fin 230 are bent five times between each adjacent set of the heat transfer tubes 22*a* to 22*c*. In the fin tube heat exchanger 20 of the embodiment, the tops 34 and the bottoms 36 on each fin 30 are bent to be symmetrical about the center of each adjacent set of the heat transfer tubes 22*a* to 22*c*. In another possible modification, neither tops nor bottoms may be bent. In this case, the fin structure is not symmetrical about the center of each adjacent set of heat transfer tubes.

In the fin tube heat exchanger 20 of the embodiment, the tops 34 and the bottoms 36 of each fin 30 are arranged to make the air flow in the cavity region behind each of the heat transfer tubes 22*a* to 22*c* in the air flow direction at the air outlet. The tops 34 and the bottoms 36 of each fin 30 may, however, be arranged to make no air flow in the cavity region behind each of the heat transfer tubes 22*a* to 22*c* in the air flow direction. In this modified structure, the tops 34 and the bottoms 36 of each fin 30 may be arranged to have a preset acute angle γ (for example, 30 degrees) to the air flow line at the air outlet like the arrangement at the air inlet.

Figure 10:
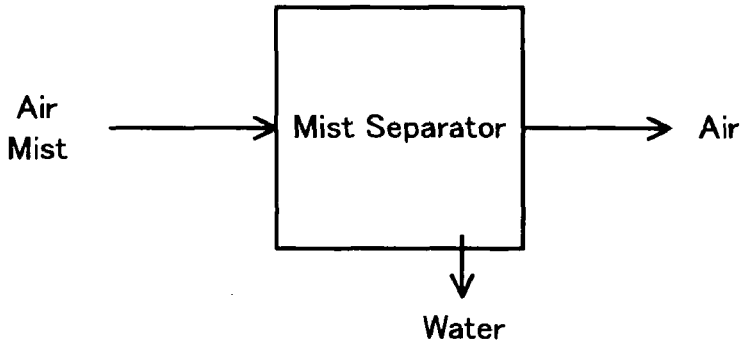
FIG. 10 schematically illustrates the structure of a mist separator as one example of an air property converter.

The embodiment regards the fin tube heat exchanger 20 according to one aspect of the invention. Another aspect of the invention pertains to an air property converter with omission of the heat transfer tubes 22*a* to 22*c* from the structure of the fin tube heat exchanger 20. One typical example of the air property converter is a mist separator. FIG. 10 schematically illustrates the structure of a mist separator as one example of the air property converter. The mist separator introduces the mist (atomized water)-rich air and separates the mist from the air to produce the mist-lean air. As mentioned above, the mist separator includes multiple fins 30 with no heat transfer tubes 22*a* to 22*c*. The introduced air flow accordingly produces secondary flows on the fins 30. The air is flowed out of the mist separator with the produced secondary flows. The mist is heavier in weight than the air and collides with the fins 30 to adhere as liquid droplets to the fins 30. Vertical arrangement of the fins 30 causes the free fall of the liquid droplets adhering to the fins 30 and thereby enables removal of the liquid droplets as water from a bottom of the mist separator. The fins 30 with the tops 34 and the bottoms 36 are effectively used in the mist separator, as well as in the heat exchanger. In application of the fins 30 to a heat exchanger, consideration of the air temperature enables the heat exchanger to be regarded as the air property converter for changing the property of the air.

Figure 11:
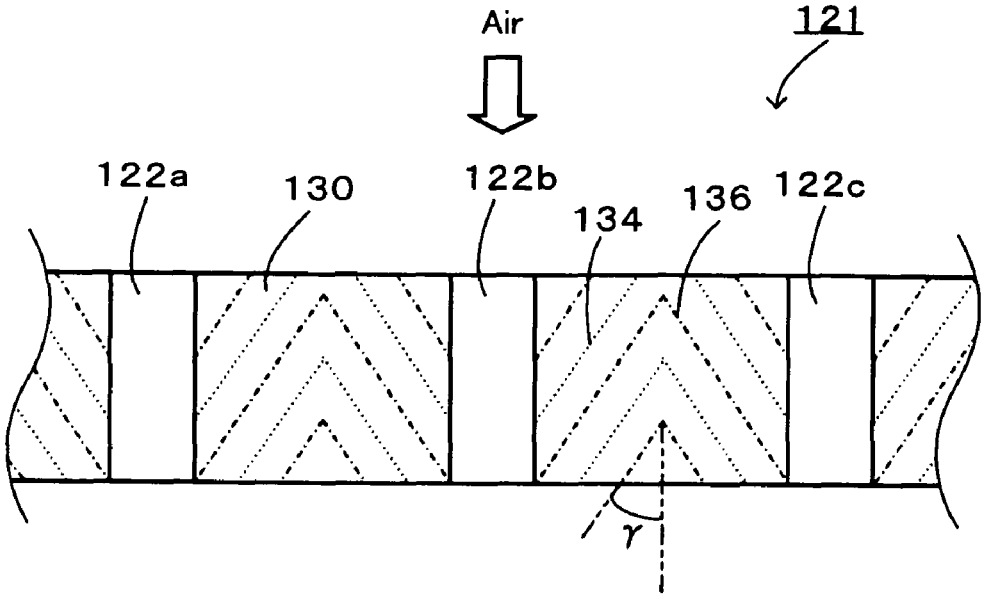
FIG. 11 is a sectional view showing a cross section of still another fin tube heat exchanger 121 in another modified example.

The fin tube heat exchanger 20 of the embodiment has the multiple heat transfer tubes 22*a* to 22*c* having the substantially circular cross section. The shape of the heat transfer tubes is, however, not restricted to the circular cross section. As shown in a modified structure of FIG. 11, a fin tube heat exchanger 121 may have multiple heat transfer tubes 122*a* to 122*c* having a rectangular cross section. In the illustrated structure, multiple fins 130, in combination with the multiple heat transfer tubes 122*a* to 122*c*, provide an air inlet and an air outlet. In the fin tube heat exchanger 121 of this modified structure, like the fin tube heat exchanger 20 of the embodiment, each fin 130 includes multiple tops 134 and bottoms 136 arranged to have a preset acute angle y to the air flow line at the air inlet. This arrangement enables production of effective secondary flows of the air to improve the heat transfer efficiency and accordingly increases the overall heat exchange efficiency. The increased overall heat exchange efficiency desirably enables size reduction of the fin tube heat exchanger 121 of this modified example. In the fin tube heat exchanger 121 of the modified structure, the respective fins 130 are attached to the heat transfer tubes 122*a* to 122*c*, and the tops 134 and the bottoms 136 of each fin 130 are designed to have the Reynolds number of not lower than 10, which is defined by the average air flow rate 'u' between the adjacent fins 130 and the amplitude 'h' of the wave formed by the tops 134 and the bottoms 136 of the fin 130. This arrangement effectively improves the heat transfer performance.

The embodiment discussed above is to be considered in all aspects as illustrative and not restrictive. There may be many modifications, changes, and alterations without departing from the scope or spirit of the main characteristics of the present invention. The scope and spirit of the present invention are indicated by the appended claims, rather than by the foregoing description.

Industrial Applicability

The technique of the present invention is preferably applicable to the manufacturing industries of heat exchangers and air property converters.

The invention claimed is:

1. A heat exchanger for heat exchange between the air and a heat exchange medium, the heat exchanger comprising:

multiple heat transfer tubes arranged in parallel to each other as flow paths of the heat exchange medium; and multiple corrugated fin members configured to have wave forms and provide an air inlet for inflow of the air, an air outlet for outflow of the air, and an air flow path connecting the air inlet with the air outlet and making heat exchange with the multiple heat transfer tubes, wherein:

the multiple fin members are arranged to have a preset acute angle formed by each wave form and a first air flow line in at least the air inlet, and the multiple fin members have wave forms such that:

a top-connecting line that connects tops of each wave form is bent multiple times between an immediate adjacent set of the multiple heat transfer tubes where a line connecting the immediate adjacent heat transfer tubes is perpendicular to a direction of the air inlet, and multiple curves are consistent with a second airflow line between the adjacent set of the multiple heat transfer tubes, the second airflow line existing between the fin members at the air inlet side, wherein each curve interconnects one of bent points of the top-connecting line of each wave form and one of bent points of a bottom-connecting line that interconnects bottoms of a wave form where the one of bent points of the bottom-connecting line is immediate adjacent to the one of bent points of the top-connecting line.

2. The heat exchanger in accordance with claim 1, wherein the multiple fin members are arranged to make each wave form symmetrical about a center of each adjacent set of the multiple heat transfer tubes.

3. The heat exchanger in accordance with claim 1, wherein the multiple fin members are arranged to have the wave forms such that the air flows in a cavity region behind each of the multiple heat transfer tubes in an air flow direction.

4. The heat exchanger in accordance with claim 1, wherein the multiple fin members are arranged to have the wave forms such that a curve of interconnecting bent points of the top-connecting lines of adjacent wave forms is consistent with the second air flow line in the predetermined range.

5. The heat exchanger in accordance with claim 1, wherein the multiple fin members are designed to give a Reynolds number of not less than 10, which is defined by an air flow rate 'u' and an amplitude 'h' of the wave form.

6. The heat exchanger in accordance with claim 1, wherein the preset acute angle is in a range of 10 degrees to 60 degrees.

7. The heat exchanger in accordance with claim 1, wherein each of the multiple heat transfer tubes has either a substantially circular cross section or a substantially rectangular cross section.

8. The heat exchanger in accordance with claim 1, wherein the multiple fin members provide the air flow path connecting the air inlet with the air outlet and intersecting with the multiple heat transfer tubes in a heat exchangeable manner.

9. The heat exchanger in accordance with claim 1, wherein the multiple heat transfer tubes provide, in combination with the multiple fin members, at least one of the air inlet and the air outlet.

10. An air conditioning device configured as a refrigeration cycle with application of a heat exchanger to at least one of an evaporator and a condenser, the heat exchanger for heat exchange between the air and a heat exchange medium, the heat exchanger comprising:

multiple heat transfer tubes arranged in parallel to each other as flow paths of the heat exchange medium; and multiple corrugated fin members configured to have wave forms and provide an air inlet for inflow of the air, an air outlet for outflow of the air, and an air flow path connecting the air inlet with the air outlet and making heat exchange with the multiple heat transfer tubes, wherein:

the multiple fin members are arranged to have a preset acute angle formed by each wave form and a first air flow line in at least the air inlet, and the multiple fin members have the wave forms such that:

a top-connecting line that connects tops of each wave form is bent multiple times between an immediate adjacent set of the multiple heat transfer tubes where a line connecting the immediate adjacent heat transfer tubes is perpendicular to a direction of the air inlet, and multiple curves are consistent with a second airflow line between the adjacent set of the multiple heat transfer tubes, the second airflow line existing between the fin members at the air inlet side, wherein each curve interconnects one of bent points of the top-connecting line of each wave form and one of bent points of a bottom-connecting line that interconnects bottoms of a wave form where the one of bent points of the bottom-connecting line is immediate adjacent to the one of bent points of the top-connecting line.

11. An air property converter that changes a property of an inflow air and flows out the air of the changed property, the air property converter comprising:

multiple corrugated fin members configured to have wave forms and provide an air inlet for inflow of the air, an air outlet for outflow of the air, and an air flow path connecting the air inlet with the air outlet, wherein:

the multiple fin members are arranged to have a preset acute angle formed by each wave form and a main stream of a first air flow in at least the air inlet, and the multiple fin members have the wave forms such that:

a top-connecting line that connects tops of each wave form is bent multiple times between an immediate adjacent set of the multiple heat transfer tubes where a line connecting the immediate adjacent heat transfer tubes is perpendicular to a direction of the air inlet, and multiple curves are consistent with a second airflow line between the adjacent set of the multiple heat transfer tubes, the second airflow line existing between the fin members at the air inlet side, wherein each curve interconnects one of bent points of the top-connecting line of each wave form and one of bent points of a bottom-connecting line that interconnects bottoms of a wave form where the one of bent points of the bottom-connecting line is immediate adjacent to the one of bent points of the top-connecting line.

* * * * *